US005734362A

United States Patent [19]

Eglit

[11] Patent Number: 5,734,362

[45] Date of Patent: Mar. 31, 1998

[54] BRIGHTNESS CONTROL FOR LIQUID CRYSTAL DISPLAYS

[75] Inventor: Alexander Julian Eglit, San Carlos, Calif.

[73] Assignee: Cirrus Logic, Inc., Fremont, Calif.

[21] Appl. No.: 474,416

[22] Filed: Jun. 7, 1995

[51] Int. Cl.[6] ..... G09G 3/06

[52] U.S. Cl. ..... 345/89; 345/87; 345/147; 345/153

[58] Field of Search ..... 345/89, 115, 116, 345/147, 153, 154, 155; 348/673, 687, 689, 695, 584, 674; 315/383

[56] References Cited

U.S. PATENT DOCUMENTS

| | | | |
|---|---|---|---|
| 4,251,755 | 2/1981 | Bryden | 315/383 |
| 5,196,937 | 3/1993 | Kageyama | 348/673 |
| 5,258,750 | 11/1993 | Malcolm, Jr. et al. | 348/584 |
| 5,321,513 | 6/1994 | Kondo et al. | 348/674 |
| 5,406,306 | 4/1995 | Siann et al. | 345/115 |
| 5,517,612 | 5/1996 | Dwin et al. | 345/185 |
| 5,572,238 | 11/1996 | Krivacic | 345/115 |

*Primary Examiner*—Regina D. Liang
*Assistant Examiner*—Ricardo Osorio
*Attorney, Agent, or Firm*—John A. Hankins; David L. Stewart; Steven A. Shaw

[57] ABSTRACT

An arrangement and method for adjusting the brightness of an image signal having digital pixel values to produce brightness adjusted output pixel values is provided with an adder and lower and upper clamp circuits. The adder adds a brightness value to the digital pixel values of the image signal to produce adjusted pixel values and a carry-out signal. The lower clamp circuit clamps the adjusted pixel values to a lowest output pixel value when the carry-out signal and the brightness value indicate that addition of the brightness value to the digital pixel values produces adjusted pixel values below the lowest output pixel value. The upper clamp circuit clamps the adjusted pixel values to a highest output pixel value when the carry-out signal and the brightness value indicate that addition of the brightness value to the digital pixel values produces adjusted pixel values above the highest output pixel value. The brightness adjuster can be used in a motion video architecture data path to compensate for the brightness response of certain displays, such as LCD displays.

25 Claims, 3 Drawing Sheets

BRIGHTNESS CONTROL FOR LIQUID CRYSTAL DISPLAYS

BACKGROUND OF THE INVENTION

1. Technical Field of the Invention

The present invention relates generally to computer graphics systems, and more particularly, to a brightness control mechanism in liquid crystal display (LCD) graphics controllers.

2. Description of the Related Art

Due to size constraints, flat-panel displays have become increasingly common as an alternative to cathode-ray tubes (CRT) in laptop computers, portable test equipment and small-screen television receivers. LCD displays, plasma and electroluminescent displays are three examples of the flat-panel technology. LCD displays work in low voltage ranges, making them especially well suited for portable electronics. Instead of the electron beams in a CRT that may be deflected by means of electromagnetic or electrostatic fields, an LCD panel is composed of an assembly of discrete light-emitting elements that must be selected and driven by electrical signals corresponding to the intensity of television picture elements (pixels). However, the already low contrast in such direct-drive circuits decreases with an increase in the number of horizontal lines and the number of pixels per line.

Incoming video signals from most sources are gamma-corrected with a gamma (transfer gradient) of 2.2 for NTSC and 2.8 for European standards. This gamma correction is optimal for displaying such a video signal on the CRT tube found in most television receivers, since such tubes have exponential brightness vs. input voltage curve and the resulting brightness response of the overall system is more or less linear. However, for computers, this is not the case.

Even with CRT displays, the gamma of computer tubes are different (normally approximately 1.8 or less) because these tubes use different phosphors. Hence, without gamma removal for computer system displays, the brightness response of such a system will have a logarithmic shape resulting in low video contrast with average brightness nearer the dark side. In other words, the average brightness of the played back video is low, and the video appears dim. It is therefore desirable to remove pre-encoded gamma from incoming video signals in order to improve the overall contrast of the picture.

An example of the transfer curve for a transmitted video signal corrected in accordance with the NTSC requirements is shown in FIG. 1A. This signal is generated to compensate for the brightness response of the CRT display shown in FIG. 1B. The resulting compensated transfer curve of the CRT display is shown in FIG. 1C. The image on an LCD display is much darker than on an CRT display. As shown in FIG. 1E, the brightness response of an LCD display differs from that of the CRT display. Accordingly, the gamma corrected transmitted video signal (FIG. 1D) causes the resulting brightness response (FIG. 1F) of the LCD display to be non-linear. This brightness response therefore results in a substantial reduction of the contrast in the LCD display.

Gamma removal creates another problem. Because of its exponential correction for normalized data (i.e., for data with range {0 . . . 1} the output is always less than or equal to the input data), the average brightness of the output image will be much less than that of the input image. For example, if the input value is 0.5 (128 in straight binary 8-bit coding) and gamma is 2.0, the output will be 0.25 (two times dimmer than the original). This will be even worse in LCD systems, because LCD systems are highly nonlinear in the first 10–15% of the brightness range. Without a brightness adjustment, the average video level would remain in this area.

SUMMARY OF THE INVENTION

There is therefore a need for a brightness adjuster that corrects the brightness response of an LCD display, and thereby improves the contrast of the LCD display.

These and other needs are met by the present invention which provides a brightness adjustment arrangement for adjusting the brightness of an input image signal having digital pixel values within a range of values to produce brightness adjusted output pixel values within the same range of values. The brightness adjustment arrangement comprises an adder that adds a user-definable signed brightness value to the digital pixel values of the image signal to produce adjusted pixel values and a carry-out signal, and a clamp circuit that clamps the adjusted pixel values to within said range of values.

Another aspect of the present invention provides a brightness adjustment arrangement for adjusting brightness of an image signal having digital pixel values to produce brightness adjusted output pixel values, comprising an adder and lower and upper clamp circuits. The adder adds a brightness value to the digital pixel values of the image signal to produce adjusted pixel values and a carry-out signal. The lower clamp circuit clamps the adjusted pixel values to a lowest output pixel value when the carry-out signal and the brightness value indicate that addition of the brightness value to the digital pixel values produces adjusted pixel values below the lowest output pixel value. The upper clamp circuit clamps the adjusted pixel values to a highest output pixel value when the carry-out signal and the brightness value indicate that addition of the brightness value to the digital pixel values produces adjusted pixel values above the highest output pixel value.

The addition of a brightness value to the digital pixel values of an image allows for the adjustment of the brightness of the image by changing the digital pixel values that are provided to a display. The brightness value can be changed to provide a different brightness response depending on the different types of display used. The clamping of the adjusted pixel values assures that the lowest and highest pixel values will be within the output range of the pixel values for the image data that the display is able to receive. In other words, if the highest pixel value, for example 255, represents the whitest white, then the addition of a brightness value to this value would exceed this highest pixel value. The clamping circuit therefore clamps the output pixel value to ensure that the highest pixel value received by the display is 255, and similarly, that the lowest pixel value received by the display is 0.

The earlier stated needs are also met by another aspect of the present invention which provides a graphics controller that receives image data from a video memory and controls display of images on a display. The graphics controller comprises a video controller that produces a graphic presentation, a computer graphics controller that controls graphics operations, a sequencer coupled to the video controller and the computer graphics controller to control timing of the video controller and the computer graphics controller, and a motion video architecture data path that receives the image data from the video memory and incorporates motion video into the graphic presentation produced by the video controller. The motion video architecture data path includes a brightness adjuster that adds a brightness value to the value of each pixel of the image data received from the video memory to produce brightness adjusted pixels of the image data received from the video memory.

The graphics controller of the present invention is able to provide to an LCD or other type display, both a graphic presentation from a video controller and motion video with image data that has been adjusted for brightness. Hence, on an LCD display, the graphic presentation portion of the displayed image will be displayed as usual, while the motion video part of the displayed image will be displayed with increased brightness due to the brightness adjustment of the pixels.

Another aspect of the present invention produces a motion video architecture data path for providing a motion picture window within a display, comprising a formatter that formats supplied image data into a format containing a luminance value for each pixel within the image data, a brightness adjuster that adds a brightness value to the luminance value of each pixel to produce brightness adjusted pixels of the image data, and a color space converter that converts the format of the brightness adjusted pixels to a format renderable by a display device.

The motion video architecture data path of the present invention provides for the receipt of data in a number of different formats, the data then being converted to a format (such as YUV) that has a luminance value for each pixel. The brightness adjustment is then made to the luminance value. The color space converter then converts the adjusted data to a format suitable for rendering by any display device, such as RGB format. The formatter and color converter therefore allow the brightness adjuster in the motion video architecture data path to be used with any number of different formats.

A still further aspect of the present invention provides a system comprising a display that receives image data and produces a visible image display, a video memory that stores the image data, a computer that provides the image data to the video memory, and a graphics controller that retrieves the image data stored in the video memory and supplies the image data to the display. The graphics controller includes a brightness adjuster that adds a brightness value to the value of each pixel of the image data received from the video memory to produce brightness adjusted pixels of the image data received from the video memory.

One of the advantages of this aspect of the present invention is that it provides a system with an improved image display, as the brightness adjustment improves both the brightness response and contrast of a display, such as an LCD display.

Another aspect of the present invention provides a method of adjusting a brightness response of a display, comprising the steps of adding a brightness value to values of pixels in an image to be displayed to produce brightness adjusted pixels, clamping values of any of the brightness adjusted pixels that fall below a lowest output pixel value to the lowest output pixel value, and values of any of the brightness adjusted pixels that are above a highest output pixel value to the highest output pixel value, and providing the brightness adjusted pixels to the display.

The foregoing and other features, aspects and advantages of the present invention will become more apparent from the following detailed description of the present invention when taken in conjunction with the accompanying drawings.

BRIEF DESCRIPTION OF THE DRAWINGS

FIGS. 1 (D)–(F) are diagrams depicting the brightness response of conventional LCD displays.

DETAILED DESCRIPTION OF THE ILLUSTRATIVE EMBODIMENTS

The following description of the present invention is provided in the context of a Super Video Graphics Array (SVGA) graphics controller card built according to the Video Graphics Array (VGA) standard to enable a host computer to provide graphic presentation of data on an LCD display. However, this embodiment is exemplary only, as the present invention is generally applicable to the field of displaying images on a video monitor.

Figure 1A:
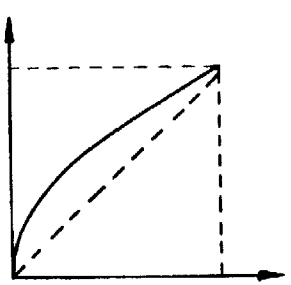
Figure 1A (PRIOR ART)
FIGS. 1 (A)–(C) are diagrams depicting the brightness response of conventional CRT displays.
Figure 1B:
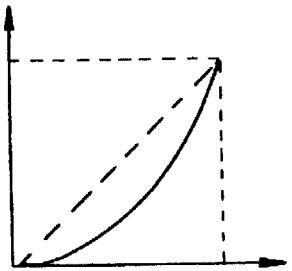
Figure 1B (PRIOR ART)
Figure 1C:
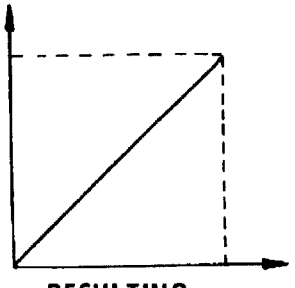
Figure 1C (PRIOR ART)
Figure 1D:
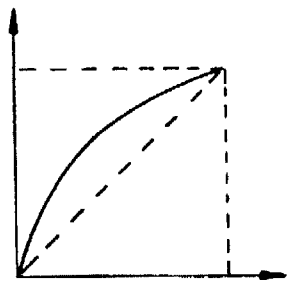
Figure 1D (PRIOR ART)
Figure 1E:
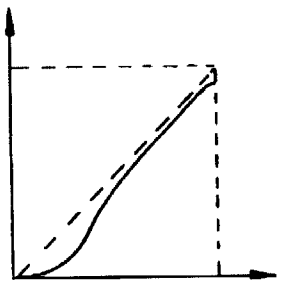
Figure 1E (PRIOR ART)
Figure 1F:
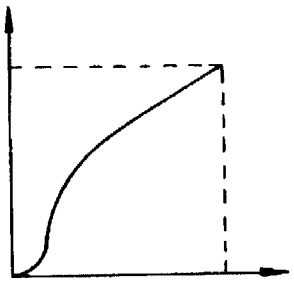
Figure 1F (PRIOR ART)
Figure 2:
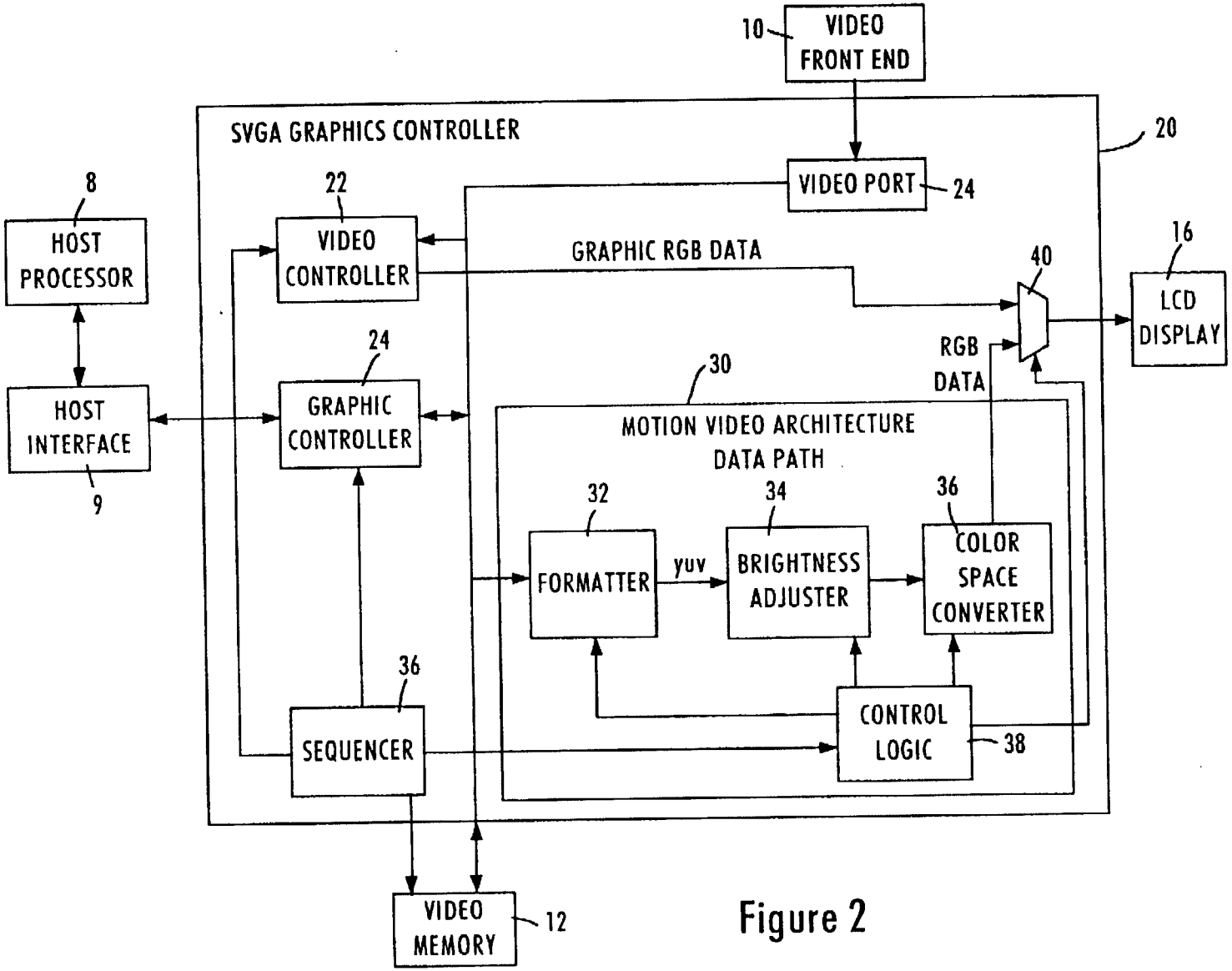
FIG. 2 is a block diagram of a graphics controller constructed in accordance with an embodiment of the present invention.

Referring to FIG. 2, a host computer 8 interacts with a video memory 12 through a host interface 9 and a graphics controller 24. The graphics controller 24 is part of an SVGA graphics controller 20 that has a video port 14 connected to a video front end 10. The video memory 12 may comprise, for example, a random access memory that periodically receives image data from the host computer 8 to refresh an LCD display 16.

The image data from the video memory 12 is supplied to a video controller 22 that may incorporate LCD control circuitry to generate appropriate colors or grey scales on a panel of the LCD display 16. The video controller 22 also includes a CRT controller. The computer graphics controller 24 assists the host computer 8 in performing graphics-oriented operations. These operations include rotate, bit masking, and z-plane operations with four boolean operations in response to a single computer write.

A timing sequencer 26 provides timing control for the video controller 22, graphics controller 24 and video memory 12. This timing control includes horizontal count resolution (8 or 9 dots/character), the various dot (pixel) clocks, and the video loading circuitry. The video controller 22 supplies the LCD display 16 with graphics data in an RGB format (e.g., 24 bits/pixel), for example, represented by a set of red, green and blue (RGB) color signals to provide graphic presentation on the panel of the display 16. The supplying of data in RGB format is exemplary only, as this format is particularly suited for use with LCD displays.

A motion video architecture (MVA) data path 30 is coupled to the video memory 12 and provides a motion picture window within the panel of the LCD display 16. For example, the MVA data path 30 may incorporate motion video into the graphic presentation currently provided by the video controller 22. A system for displaying a motion picture window is disclosed in more detail in co-pending application Ser. No. 08/235,764 entitled "VARIABLE PIXEL DEPTH AND FORMAT FOR VIDEO WINDOWS", which is incorporated herein by reference.

The MVA 30 according to the exemplary embodiment of the present invention has a formatter 32 that formats the image data supplied by the video memory 12 into a YUV data format (e.g., 24 bits/pixel) that represents a color-difference set including a luminance value Y and color-difference signals U and V. The YUV data are supplied by the formatter 32 to a brightness adjuster 34 that adds a programmable 8-bit brightness value B to the luminance value Y of each pixel received from the video memory 12 to correct a brightness response of the LCD display 16. The color-difference signals U and V are not affected by the brightness adjustment. In alternative embodiments, instead of YUV formatted signals, image data in an RGB format representing a set of color signals R, G and B may be supplied to the brightness adjuster 34. The structure and operation of the brightness adjuster 34 will be described in more detail later with respect to FIG. 3.

A color space converter (CSC) 36 converts the brightness adjusted YUV output data of the brightness adjuster 34 into an RGB data format (e.g., 24 bits/pixel) required by the LCD display 16. The graphics RGB data from the video controller 22 and the motion video RGB data formed by the color space converter 36 are supplied to the LCD display 16 through a multiplexer 40. Control logic 38 counts pixels to define the position of the motion picture window on the panel of the LCD display 16. The control logic 38 supplies the multiplexer 40 with a select signal to enable either the graphic RGB data or motion video RGB data to be passed to the LCD display 16. The control logic 38 is timed by the sequencer 26, and also controls the operation of the formatter 32 and color space converter 36.

Figure 3:
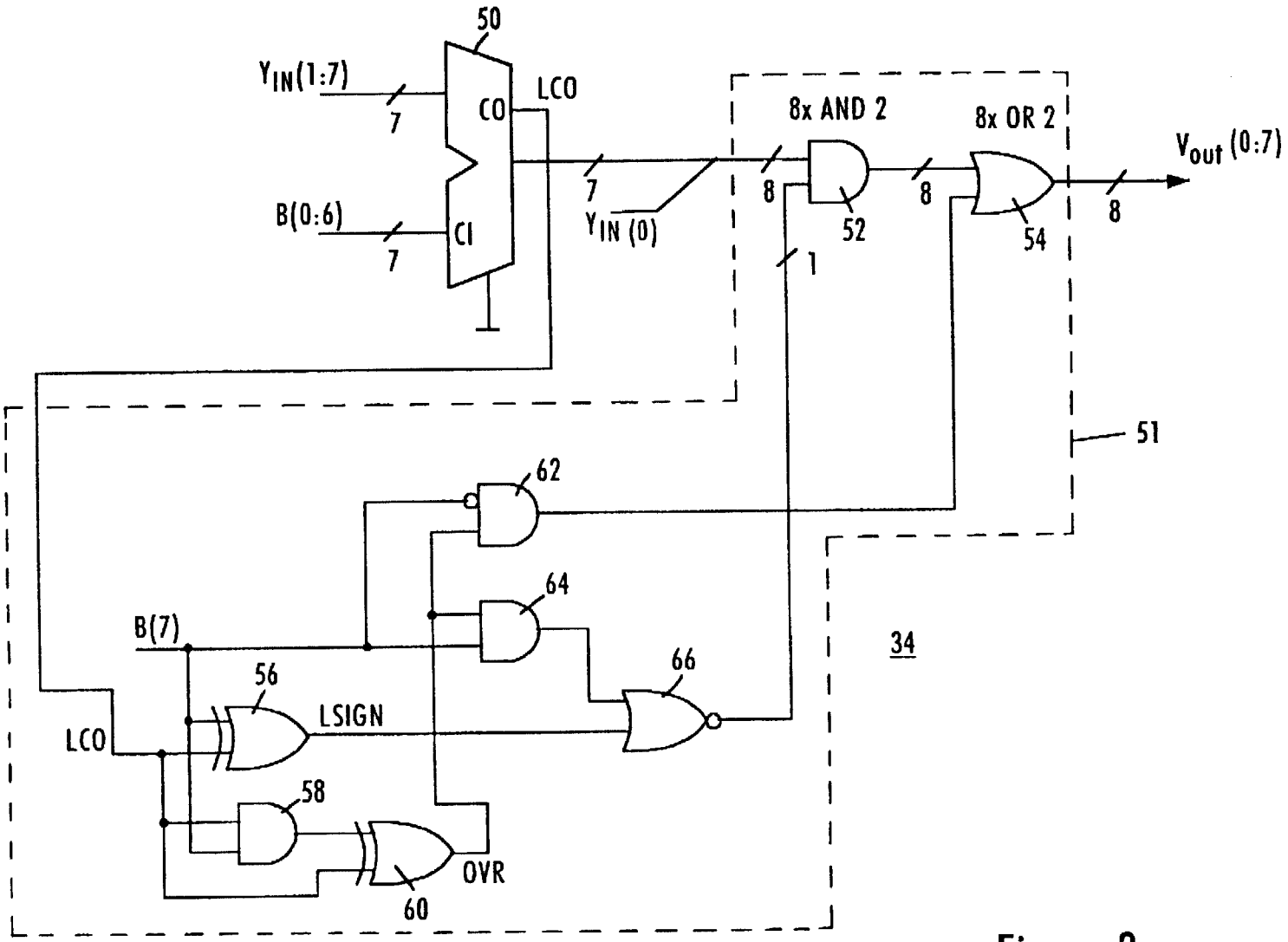
FIG. 3 is a diagram illustrating brightness adjuster circuitry constructed in accordance with an embodiment of the present invention.

FIG. 3 is a diagram of a brightness adjuster 34 constructed in accordance with an embodiment of the present invention. The brightness adjuster 34 has a 7-bit full adder 50 that adds the brightness value B to the luminance value $Y_{in}$ of each pixel retrieved from the video memory 12 to be output through the MVA 30. Only the seven most significant bits of the luminance value (i.e. $Y_{in}(1:7)$) are added to the seven least significant bits of the brightness value (i.e. B(0:6)). The result of the addition is then concatenated with the least significant bit $Y_{in}(0)$ of the luminance value to produce an 8-bit brightness adjusted pixel value.

The brightness value B is in two's complement form, so that the most significant bit represents a sign bit. This allows the luminance value Y of a pixel to be adjusted either up or down, depending on the adjustment that needs to be made to achieve the desired brightness response of the display 16. This feature raises the possibility, however, of producing a brightness adjusted output value that is beyond the range expected by the display 16. For example, with an 8-bit luminance value, the darkest pixel is normally represented by a 0 pixel value, and the whitest pixel is normally represented by a 255 pixel value. As should be apparent, the addition of a positive brightness adjustment to a luminance value of 255 produces a value greater than 255, and the addition of a negative brightness adjustment to a luminance value of 0 produces a value less than zero.

Rather than present such out-of-range luminance values to the display 16, the brightness adjuster 34 of the present invention has clamping circuitry that acts to clamp the brightness adjusted pixel output value to stay within the given range of the luminance values. The clamping circuitry 51 includes a lower clamp circuit that clamps the output pixel value to a lowest output pixel value (0 for example) whenever the addition of the brightness value to the luminance value produces a result below 0. Similarly, the clamping circuitry 51 includes an upper clamp circuit that clamps the output pixel value to a highest output pixel value (255 for example) whenever the addition of the brightness value to the luminance value produces a result above 255. In this way, the darkest darks will have a pixel output value of zero (0), and the whitest whites will have a pixel output value of 255.

The clamping circuitry 51 has a first AND gate 52 that receives the 8 bits of the brightness adjusted pixel output value and a force bit that causes the clamping of the brightness adjusted pixel output value to zero (0) when the force bit has a value of 0. An OR gate 54 receives the output of the first AND gate 52 and a different force bit that causes the clamping of the brightness adjusted pixel value to 255 when the force bit has a value of 1.

The most significant bit of the brightness value (B(7)) and a luminance carry-out (LCO) generated by the adder 50 are used by the clamping circuitry 51 as the input values which determine the values of the force bits. The clamping circuitry 51 therefore includes a first exclusive-OR gate 56 that receives at its inputs B(7) and LCO. The output of the first exclusive-OR gate 56 is a signal LSIGN that represents the sign of the addition result of the adder 50. When LSIGN is high, the addition result is negative.

The same values of B(7) and LCO are also provided as inputs to a second AND gate 58. The output of the second AND gate 58 forms one input to a second exclusive-OR gate 60, whose other input is LCO. The output of the second exclusive-OR gate 60 is the overflow signal OVR, which indicates whether the addition by the adder 50 has caused an overflow.

The overflow signal OVR is an input to a third AND gate 62. The other input of the third AND gate 62 receives the inverted value of B(7). If there is a positive overflow, then B(7) will be low and OVR will be high, producing a 1 at the output of the third AND gate 62, this signal forming the force bit to the OR gate 54. When the value of the force bit is 1 indicating a positive overflow, the OR gate 54 produces an output pixel value ($Y_{out}(0:7)$) that is all 1's, i.e., clamped to a value of 255.

The overflow signal OVR also forms an input to a fourth AND gate 64 that receives B(7) at its other input. The output of the fourth AND gate 64 forms one input of a NOR gate 66, which receive LSIGN at its other input. The output of the NOR gate 66 forms the force bit provided to the first AND gate 52. When the addition of $Y_{in}$ to B produces a negative overflow, the force bit will have a value of 0, and cause the output of the first AND gate 52 to be all 0's, i.e., clamped to 0. This clamped value of 0 will then be produced by the OR gate 54 as $Y_{out}(0:7)$.

The clamping circuitry 51 of the present invention therefore differentiates between negative overflows (below 0) and positive overflows (above 255) and takes appropriate clamping action. The brightness adjusted output value of the luminance will then be maintained within the expected range of the luminance value to preserve compatibility with standard displays.

Although the present invention has been described and illustrated in detail, it is clearly understood that the same is by way of illustration and example only and is not to be taken by way of limitation, the spirit and scope of the present invention being limited only by the terms of the appended claims.

I claim:

1. A brightness adjustment arrangement for adjusting brightness of an image signal having digital pixel values to produce brightness adjusted output pixel values, comprising:

an adder that adds a brightness value to the digital pixel values of the image signal to produce adjusted pixel values and a carry-out signal;

a lower clamp circuit that receives the carry-out signal and at least one bit of the brightness value and clamps the adjusted pixel values to a lowest output pixel value when the carry-out signal and the at least one bit of the brightness value indicate that addition of the brightness value to the digital pixel values produces adjusted pixel values below the lowest output pixel value; and an upper clamp circuit that receives the carry-out signal and the at least one bit of the brightness value and clamps the adjusted pixel values to a highest output pixel value when the carry-out signal and the at least one bit of the brightness value indicate that addition of the brightness value to the digital pixel values produces adjusted pixel values above the highest output pixel value.

2. The arrangement of claim 1, wherein the digital pixel values represent luminance values of pixels of the image signal.

3. The arrangement of claim 2, wherein the brightness value is in two's complement format, with a most significant bit representing a sign of the brightness value.

4. The arrangement of claim 3, wherein the most significant bit of the brightness value is the at least one bit of the brightness value.

5. The arrangement of claim 4, wherein the upper and lower clamp circuits include an overflow determination circuit that determines whether the adder has overflowed.

6. The arrangement of claim 5, wherein the upper and lower clamp circuits further include an exclusive-OR gate responsive to the carry-out signal and the most significant bit of the brightness value to determine a sign of an overflow of the adder.

7. The arrangement of claim 6, wherein the adder is a seven-bit full adder that adds the seven most significant bits of the luminance values to the seven least significant bits of the brightness values, with the results of the addition concatenated with the least significant bit of the luminance values to produce the adjusted pixel values.

8. The arrangement of claim 7, wherein the luminance values have a range of 0 to 255, with the lowest output pixel value equal to 0 and the highest output pixel value equal to 255.

9. A motion video architecture data path for providing a motion picture window within a flat panel display, comprising:

a formatter that formats supplied image data into a format containing a luminance value for pixels within the image data;

a brightness adjuster that adds a brightness value to the luminance value of pixels to produce brightness adjusted pixels of the image data; and a color space converter that converts the format of the brightness adjusted pixels to a format renderable by said flat panel display.

10. A motion video architecture data path for providing a motion picture window within a display, comprising:

a formatter that formats supplied image data into a format containing a luminance value for pixels within the image data;

a brightness adjuster that adds a brightness value to the luminance value of pixels to produce brightness adjusted pixels of the image data; and a color space converter that converts the format of the brightness adjusted pixels to a format renderable by a display device, in which the brightness adjuster includes:

an adder that adds the brightness value to the luminance values of the pixels to produce the brightness adjusted pixels and a carry-out signal;

a lower clamp circuit that receives the carry-out signal and at least one bit of the brightness value and clamps any brightness adjusted pixel to a lowest output pixel value when the carry-out signal and the at least one bit of the brightness value indicate that addition of the brightness value to the luminance values of that pixel produces a brightness adjusted pixel value below the lowest output pixel value; and an upper clamp circuit that receives the carry-out signal and at least one bit of the brightness value and clamps any brightness adjusted pixel to a highest output pixel value when the carry-out signal and the at least one bit of the brightness value indicate that addition of the brightness value to the luminance values of that pixel produces a brightness adjusted pixel value above the highest output pixel value.

11. The motion video architecture data path of claim 10, further comprising control logic coupled to the brightness adjuster and containing a programmable brightness value that is supplied to the adder.

12. A graphics controller that receives image data from a video memory and controls display of images on a flat panel display, the graphics controller comprising:

a video controller that produces a graphic presentation;

a computer graphics controller that controls graphics operations;

a sequencer coupled to the video controller and the computer graphics controller to control timing of the video controller and the computer graphics controller; and a motion video architecture data path that receives the image data from the video memory and incorporates motion video into the graphic presentation produced by the video controller for display on said flat panel display, the motion video architecture data path including a brightness adjuster that adds a brightness value to the value of pixels of the image data received from the video memory to produce brightness adjusted pixels of the image data received from the video memory.

13. A graphics controller that receives image data from a video memory and controls display of images on a display, the graphics controller comprising:

a video controller that produces a graphic presentation;

a computer graphics controller that controls graphics operations;

a sequencer coupled to the video controller and the computer graphics controller to control timing of the video controller and the computer graphics controller; and a motion video architecture data path that receives the image data from the video memory and incorporates motion video into the graphic presentation produced by the video controller, the motion video architecture data path including a brightness adjuster that adds a brightness value to the value of pixels of the image data received from the video memory to produce brightness adjusted pixels of the image data received from the video memory, in which the brightness adjuster includes:

an adder that adds the brightness value to the value of pixels to produce the brightness adjusted pixels and a carry-out signal;

a lower clamp circuit that receives the carry-out signal and at least one bit of the brightness value and clamps any brightness adjusted pixel to a lowest output pixel value when the carry-out signal and the at least one bit of the brightness value indicate that addition of the brightness value to the value of that pixel produces a brightness adjusted pixel value below the lowest output pixel value; and an upper clamp circuit that receives the carry-out signal and at least one bit of the brightness value and clamps any brightness adjusted pixel to a highest output pixel value when the carry-out signal and the at least one bit of the brightness value indicate that addition of the brightness value to the value of that pixel produces a brightness adjusted pixel value above the highest output pixel value.

14. The graphics controller of claim 13, further comprising a multiplexer that receives the graphic presentation from the video controller and the brightness adjusted pixels from the motion video architecture data path and is responsive to a control signal to pass either the graphic presentation or the brightness adjusted pixels to a display.

15. A system comprising:

a flat panel display that receives image data and produces a visible image display;

a video memory that stores the image data;

a computer that provides the image data to the video memory; and a graphics controller that retrieves the image data stored in the video memory and supplies the image data to the flat panel display, the graphics controller including a brightness adjuster that adds a brightness value to the values of pixels of the image data received from the video memory to produce brightness adjusted pixels of the image data received from the video memory.

16. A system comprising:

a display that receives image data and produces a visible image display;

a video memory that stores the image data;

a computer that provides the image data to the video memory; and a graphics controller that retrieves the image data stored in the video memory and supplies the image data to the display, the graphics controller including a brightness adjuster that adds a brightness value to the values of pixels of the image data received from the video memory to produce brightness adjusted pixels of the image data received from the video memory in which the brightness adjuster includes:

an adder that adds the brightness value to the value of a pixel to produce the brightness adjusted pixels and a carry-out signal;

a lower clamp circuit that receives the carry-out signal and at least one bit of the brightness value and clamps any brightness adjusted pixel to a lowest output pixel value when the carry-out signal and the at least one bit of the brightness value indicate that addition of the brightness value to the value of that pixel produces a brightness adjusted pixel value below the lowest output pixel value; and an upper clamp circuit that receives the carry-out signal and at least one bit of the brightness value and clamps any brightness adjusted pixel to a highest output pixel value when the carry-out signal and the at least one bit of the brightness value indicate that addition of the brightness value to the value of that pixel produces a brightness adjusted pixel value above the highest output pixel value.

17. The system of claim 15, wherein the display is a liquid crystal display (LCD).

18. The system of claim 16, wherein the graphics controller further includes a formatter that formats the supplied image data into a YUV format containing a luminance value for each pixel within the image data, and a color space converter that converts the format of the brightness adjusted pixels to RGB format compatible for rendering by the display.

19. A method of adjusting a brightness response of a display, comprising:

adding a brightness value to values of pixels in an image to be displayed to produce brightness adjusted pixels;

clamping values of any of the brightness adjusted pixels that fall below a lowest output pixel value to the lowest output pixel value, and values of any of the brightness adjusted pixels that are above a highest output pixel value to the highest output pixel value; and providing the brightness adjusted pixels to the display, in which the step of adding includes adding in an adder the brightness value to the value of each pixel in the image to produce the brightness adjusted pixels and a carry-out signal.

20. The method of claim 19, wherein the step of clamping includes the steps of receiving in a lower clamp circuit the carry-out signal and at least one bit of the brightness value and clamping any brightness adjusted pixel to a lowest output pixel value when the carry-out signal and the at least one bit of the brightness value indicate that addition of the brightness value to the value of that pixel produces a brightness adjusted pixel value below the lowest output pixel value; and receiving in an upper clamp circuit the carry-out signal and at least one bit of the brightness value and clamping any brightness adjusted pixel to a highest output pixel value when the carry-out signal and the at least one bit of the brightness value indicate that addition of the brightness value to the value of that pixel produces a brightness adjusted pixel value above the highest output pixel value.

21. A method of adjusting a brightness response of a display, comprising:

adding a brightness value to values of pixels in an image to be displayed to produce brightness adjusted pixels;

clamping values of any of the brightness adjusted pixels that fall below a lowest output pixel value to the lowest output pixel value, and values of any of the brightness adjusted pixels that are above a highest output pixel value to the highest output pixel value; and providing the brightness adjusted pixels to the display, in which the image data is in a YUV format, and the values of the pixels to which the brightness values are added are luminance values.

22. The method of claim 21, wherein the step of providing includes converting the image data with the brightness adjusted pixels to RGB format.

23. A brightness adjustment arrangement for adjusting brightness of an input image signal having digital pixel values to produce brightness adjusted output pixel values within a desired range of values, comprising:

an adder that adds a user-definable signed brightness value to the digital pixel values of the image signal to produce adjusted pixel values and a carry-out signal; and a clamp circuit that clamps the adjusted pixel values to within said desired range of values.

24. The arrangement of claim 23, wherein the clamp circuit includes a lower clamp circuit that receives the carry-out signal and at least one bit of the brightness, value and clamps the adjusted pixel values to a lowest output pixel value when the carry-out signal and the at least one bit of the brightness value indicate that addition of the brightness value to the digital pixel values produces adjusted pixel values below the lowest output pixel value; and an upper clamp circuit that receives the carry-out signal and the at least one bit of the brightness value and clamps the adjusted pixel values to a highest output pixel value when the carry-out signals and the at least one bit of the brightness value indicate that addition of the brightness value to the digital pixel values produces adjusted pixel values above the highest output pixel value.

25. The arrangement of claim 24, wherein the range is 0 to 255.

* * * * *